US010253521B2

(12) United States Patent
Choi

(10) Patent No.: US 10,253,521 B2
(45) Date of Patent: Apr. 9, 2019

(54) TENT

(71) Applicant: Campvalley (Xiamen) Co., Ltd., Xiamen (CN)

(72) Inventor: Kwan Jun Choi, Xiamen (CN)

(73) Assignee: CAMPVALLEY (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 15/878,425

(22) Filed: Jan. 24, 2018

(65) Prior Publication Data

US 2019/0063106 A1 Feb. 28, 2019

(30) Foreign Application Priority Data

Aug. 28, 2017 (CN) ..... 2017 2 1083191 U

(51) Int. Cl.

| | |
|---|---|
| ***E04H 15/10*** | (2006.01) |
| ***E04H 15/32*** | (2006.01) |
| ***F21S 4/20*** | (2016.01) |
| *F21Y 103/10* | (2016.01) |
| *E04H 15/42* | (2006.01) |
| *F21Y 115/10* | (2016.01) |

(52) U.S. Cl.

CPC ..... *E04H 15/32* (2013.01); *E04H 15/10* (2013.01); *F21S 4/20* (2016.01); *E04H 15/42* (2013.01); *F21Y 2103/10* (2016.08); *F21Y 2115/10* (2016.08)

(58) Field of Classification Search

CPC ..... E04H 15/10

See application file for complete search history.

(56) References Cited

U.S. PATENT DOCUMENTS

| | | | | |
|---|---|---|---|---|
| 4,839,777 | A * | 6/1989 | Janko | A41D 27/085 362/103 |
| 7,455,427 | B1 * | 11/2008 | Freeman | E04H 15/10 135/91 |
| 8,262,250 | B2 * | 9/2012 | Li | F21V 17/007 362/219 |
| 9,243,797 | B2 * | 1/2016 | Leung | F21V 33/0008 |
| 2003/0179576 | A1 * | 9/2003 | Huang | E04H 15/32 362/253 |
| 2008/0029141 | A1 * | 2/2008 | Grand Pre | E04H 15/10 135/91 |
| 2008/0173341 | A1 * | 7/2008 | Falin | E04F 10/00 135/91 |
| 2015/0034137 | A1 * | 2/2015 | Tanaeim | E04H 15/10 135/91 |
| 2016/0015102 | A1 * | 1/2016 | Fonte | F21V 33/0008 362/108 |
| 2017/0292285 | A1 * | 10/2017 | Jin | F21V 23/04 |

FOREIGN PATENT DOCUMENTS

WO WO-2015183926 A1 * 12/2015 ..... F21V 33/006

* cited by examiner

*Primary Examiner* — Noah Chandler Hawk
(74) *Attorney, Agent, or Firm* — Gokalp Bayramoglu

(57) ABSTRACT

A tent including a frame and a tent cloth connected to the frame. A fixing member is sewn with the tent cloth. The fixing member is provided with a LED strip light. The LED strip light and the tent cloth are separated in the design of the tent, so the heat generated by the strip light would not be directly transferred to the tent cloth since the LED strip light and the tent cloth are not directly in contact with each other, thereby greatly reducing the possibility of the tent cloth getting burnt.

6 Claims, 4 Drawing Sheets

TENT

CROSS REFERENCE TO RELATED APPLICATIONS

This application is based upon and claims priority to Chinese Patent Application No. 201721083191.8, filed on Aug. 28, 2017, the entire contents of which are incorporated herein by reference.

TECHNICAL FIELD

The present disclosure relates to a tent.

BACKGROUND

Tents are temporary shelters from wind and rain which allow sunshine to come in. Generally, tents are made of canvas which can be removed at any time together with the support structure. Tents are usually carried to the spot as parts and are assembled on site, so, many parts and tools are needed when assembling tents. In order to set up a tent quickly and easily, the name and use of each part and the structure of the tent should be understood first.

As the standard of living has improved, the demand for tents has also increased. Although the existing tents are provided with lights, where the lights are directly sewn within the tent cloth. Thus, heat generated by the lights would be directly transferred to the tent cloth. Therefore, it is possible that the tent cloth may get burnt, causing a security risk.

SUMMARY OF THE INVENTION

In order to solve the above-mentioned technical problems, the objective of the present disclosure is to provide a tent.

The present disclosure is realized through the following technical solutions.

A tent includes a stand and a tent cloth connected to the stand, wherein a fixing member is sewn with the tent cloth, and the fixing member is provided with a LED strip light.

In an embodiment of the present disclosure, each side of the fixing member along a width direction is provided with a flank piece, and the flank piece is sewn with the tent cloth.

In an embodiment of the present disclosure, a middle part of the fixing member is provided with a cavity for mounting the LED strip light, and the cavity is internally provided with a block cooperating with the LED strip light.

In an embodiment of the present disclosure, the flank piece is provided with a groove, and the fixing member is sewn with the tent cloth at the groove.

In an embodiment of the present disclosure, the fixing member includes a fixing piece sewn with the tent cloth, wherein, the fixing piece is provided with a slot. The fixing member further includes a shell for mounting the LED strip light. The shell is provided with an inserting piece cooperating with the slot.

The tent of the present disclosure has the following advantages. The LED strip light and the tent cloth are separate in the design of the tent, so the heat generated by the strip light would not be transferred to the tent cloth since the LED strip light and the tent cloth are not directly in contact with each other, thereby greatly reducing the possibility of the tent cloth getting burnt.

BRIEF DESCRIPTION OF THE DRAWINGS

To clearly illustrate the technical solutions of the present disclosure, the drawings required for describing the embodiments or the prior art will be briefly introduced hereinafter. Apparently, the drawings described hereinafter merely show a part of embodiments of the present disclosure. Other drawings may be derived from the provided drawings by those of ordinary skill in the art without any creative efforts.

DETAILED DESCRIPTION OF THE INVENTION

The technical solutions in the embodiments of the present disclosure will be clearly and completely described with reference to the drawings according to the embodiments of the present disclosure. Apparently, merely partial embodiments of the present disclosure are described rather than all the embodiments. Based on the embodiments of the present disclosure, other embodiments derived by those of ordinary skill in the art without any creative efforts should fall within the scope of the present disclosure.

With reference to the drawings, the first embodiment of the present disclosure is as follows.

Figure 1:
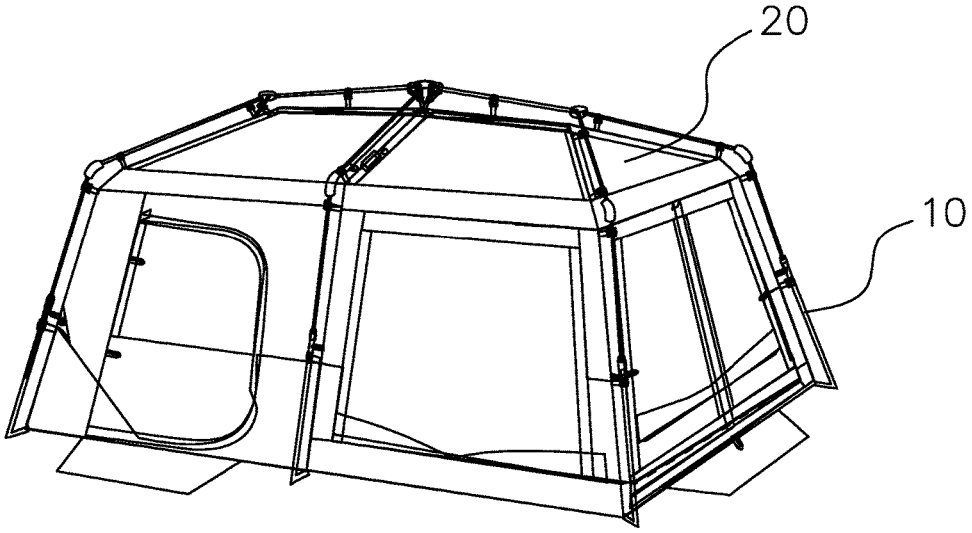
FIG. 1 is a schematic view of the present disclosure.
Figure 2:
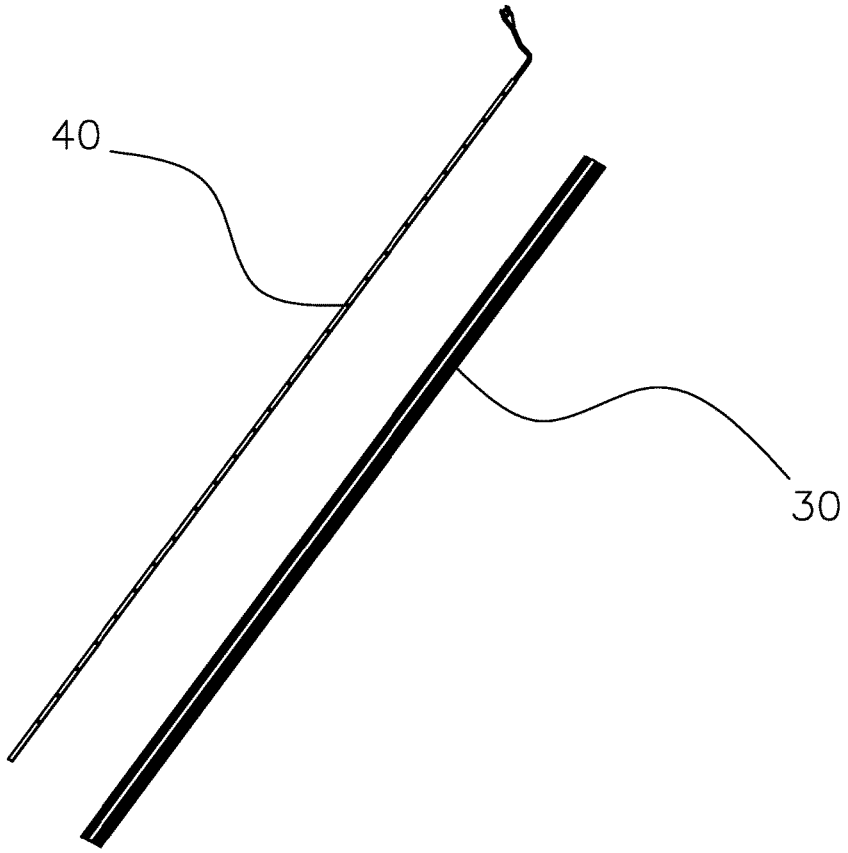
FIG. 2 is a schematic view of the first embodiment of the present disclosure.
Figure 3:
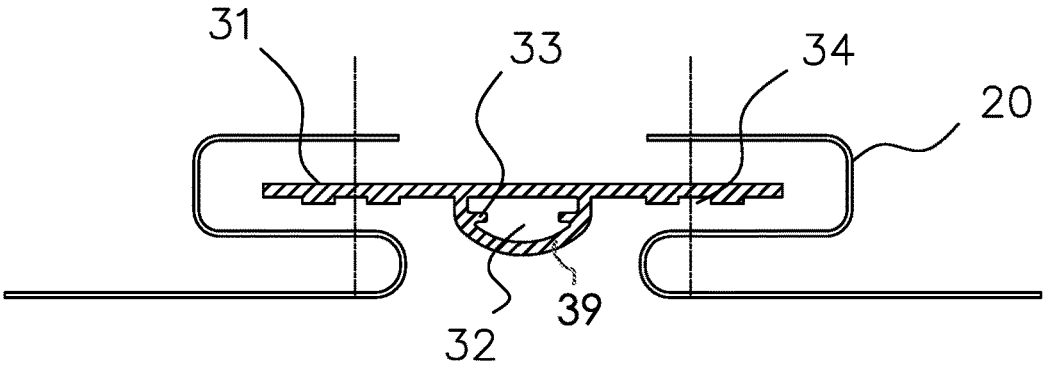
FIG. 3 is a schematic view of the first suture manner of the present disclosure.
Figure 4:
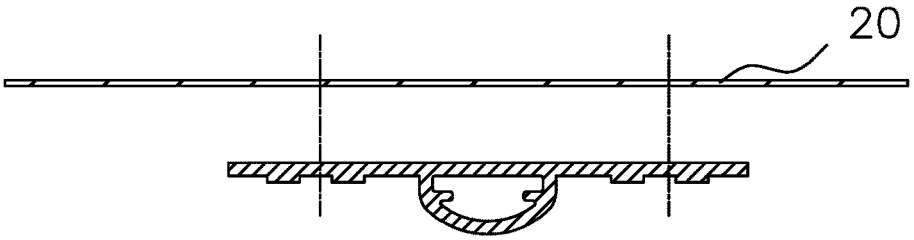
FIG. 4 is a schematic view of the second suture manner of the present disclosure.
Figure 5:
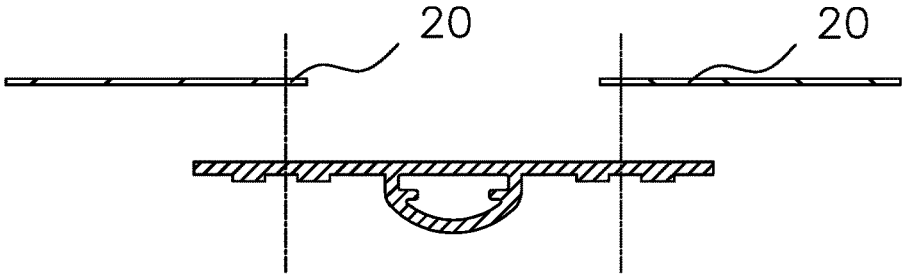
FIG. 5 is a schematic view of the third suture manner of the present disclosure.
Figure 6:
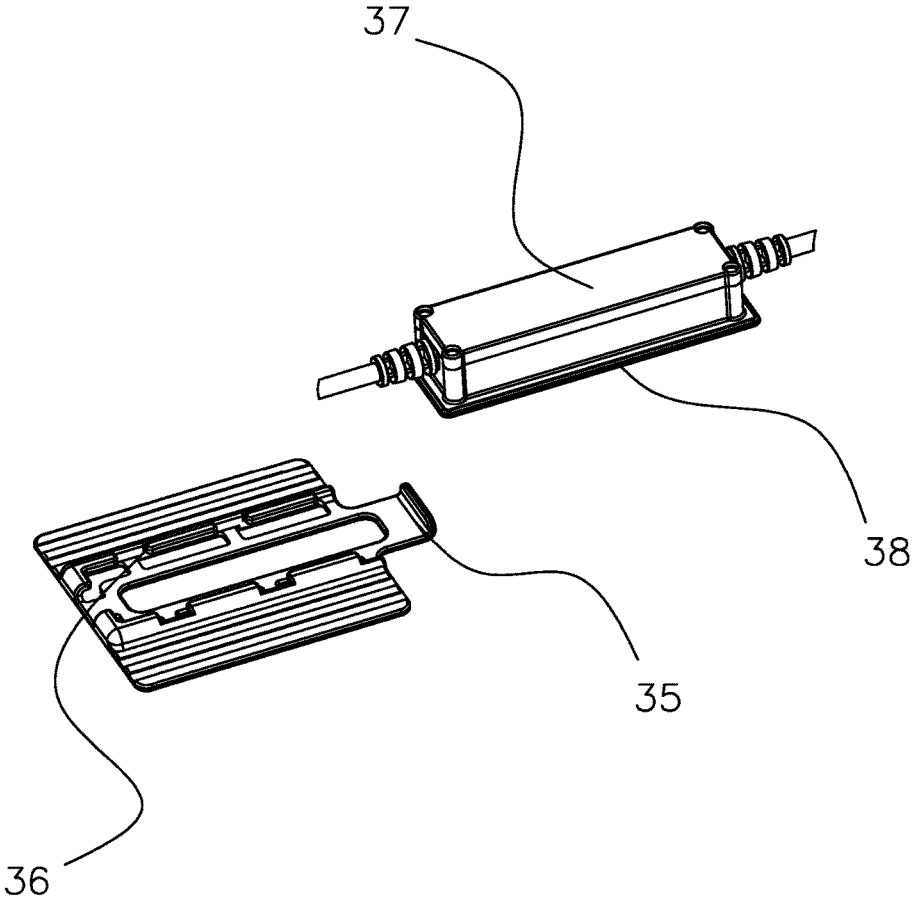
FIG. 6 is a schematic view of the second embodiment of the present disclosure.

Referring to FIG. 1, a tent includes a frame 10 and tent cloth 20 connected to the frame 10. A fixing member 30 is sewn with the tent cloth 20, and the fixing member 30 is provided with a LED strip light 40. Each side of the fixing member 30 along a width direction is provided with flank pieces 31, and the flank pieces 31 are sewn with the tent cloth 20.

Specifically, the center of the fixing member is provided with a cavity 32 for mounting the LED strip light 40. A wall 39 surrounding the cavity 32 is internally provided with a block 33 which matches the LED strip light 40. The flank piece 31 is provided with a groove 34, the fixing member 30 is sewn with the tent cloth 20 at the position of the groove 34. A plurality of grooves 34 may be provided according to the demand.

In the present disclosure, there may be many suture manners for suturing the tent cloth 20 and the fix member 30. For example, three types of suture manners are listed below. In the first suture manner, the whole piece of tent cloth 20 is directly positioned below the fixing member 30 and is directly sewn with the fixing member 30. In the second suture manner, the tent cloth 30 is divided into two pieces which are respectively located below the flank pieces 31. In the third suture manner, the tent cloth 20 is divided into two pieces which are respectively sewn by enclosing the flank pieces 31. Please refer to the drawings for more details.

With reference to the drawings, the second embodiment of the present disclosure is as follows.

A tent includes a frame 10 and tent cloth 20 connected to the frame 10, wherein a fixing member 30 is sewn with the tent cloth 20, and the fixing member 30 is provided with a LED strip light 40. Each side of the fixing member 30 along a width direction is provided with flank pieces 31, and the flank pieces are sewn with the tent cloth 20.

The fixing member 30 includes a fixing piece 35 sewn with the tent cloth 20, the fixing piece 35 is provided with a slot 36. The fixing member 30 further includes a shell 37 for mounting the LED strip light 40. The shell 37 is provided with an inserting piece 38, where the inserting piece 38 matches the slot 36.

The above disclosure merely shows the preferred embodiments of the present disclosure, which cannot be used to limit the scope of the present disclosure. Therefore, the equivalent variations made according to the appending claims of the present disclosure should still fall within the scope of the present disclosure.

What is claimed is:

1. A tent, comprising:

a frame;

a tent cloth connected to the frame; and a fixing member; wherein the fixing member is provided with a cavity within the fixing member and a wall surrounding the cavity is provided with a plurality of blocks, wherein the plurality of blocks extend inwardly from opposite sides of the wall and extend toward each other;

wherein the fixing member is provided with a LED strip light, wherein each side of the fixing member along a width direction is provided with a flank piece, and the flank piece is sewn with the tent cloth.

2. The tent of claim 1, wherein a center of the fixing member is provided with the cavity for mounting the LED strip light, and the plurality of blocks match up with the LED strip light.

3. The tent of claim 2, wherein the flank piece is provided with a groove, and the fixing member is sewn with the tent cloth at the groove.

4. A tent, comprising:

a frame;

a tent cloth connected to the frame; and a fixing member; wherein the fixing member is provided with a cavity within the fixing member and a wall surrounding the cavity is provided with two blocks, wherein the two blocks extend inwardly from opposite sides of the wall and extend toward each other;

wherein the fixing member is provided with a LED strip light, wherein each side of the fixing member along a width direction is provided with a flank piece, and the flank piece is sewn with the tent cloth.

5. A tent, comprising:

a frame;

a tent cloth connected to the frame; and a fixing member;

wherein the fixing member is provided with a cavity within the fixing member;

wherein the fixing member is provided with a LED strip light, wherein each side of the fixing member along a width direction is provided with a flank piece, and the flank piece is sewn with the tent cloth; and wherein the tent cloth is divided into two pieces which are respectively located below each of the flank piece; or wherein the tent cloth is divided into two pieces which are respectively sewn by enclosing each of the flank piece.

6. The tent of claim 5, wherein the flank piece is provided with a groove, and the fixing member is sewn with the tent cloth at the groove.

* * * * *